United States Patent [19]

Salvo

[11] Patent Number: 4,798,940

[45] Date of Patent: Jan. 17, 1989

[54] MANUAL CALCULATOR FOR ANALOG AND DIGITAL NUMBERS

[76] Inventor: Gaetano Salvo, 3748 Michigan Ave., Charlotte, N.C. 28215

[21] Appl. No.: 897,975

[22] Filed: Aug. 19, 1986

[51] Int. Cl.[4] ..... G06G 1/02

[52] U.S. Cl. ..... 235/70 R; 235/70 A

[58] Field of Search ..... 235/69, 70 R, 70 A, 235/78 M, 88 M, 89 R

[56] References Cited

U.S. PATENT DOCUMENTS

| | | | |
|---|---|---|---|
| 1,892,634 | 12/1932 | Rubinsky | 235/69 |
| 3,712,974 | 1/1973 | Martin | 235/70 R |
| 3,837,569 | 9/1974 | Bradbury et al. | 235/88 M X |
| 3,843,048 | 10/1974 | Haase | 235/88 M X |
| 3,916,161 | 10/1975 | Hancock | 235/69 |
| 4,323,609 | 4/1982 | Bromberg | 235/78 R X |
| 4,633,070 | 12/1986 | Merkl | 235/70 M X |

*Primary Examiner*—Benjamin R. Fuller
*Attorney, Agent, or Firm*—Daniel E. McConnell

[57] ABSTRACT

A manual calculator useful in registering and converting whole and fractional numbers from one numbering system to another numbering system in which a plurality of slide members are arranged in an array within a cover, with each said slide member being movable relative to the cover between first and second positions. The slide members each bear indicia indicative of the selected ones of two states, and the cover defines an elongate window in which the indicia borne by the slide members are visible in an array indicative of a selected number series in a first numbering system. The cover also bears a plurality of sets of indicia with each set having a predetermined correlation to number series expressed in a differing preselected numbering system, with the sets of indicia being arranged relative to the window and slide members so as to be perpendicular to the direction of movement of the slide members and with numerical values in each system aligned with a corresponding one of the slide members whereby the positions of said slide members may be manipulated to indicate a number series in a first numbering system and corresponding number series in different numbering systems.

12 Claims, 1 Drawing Sheet

MANUAL CALCULATOR FOR ANALOG AND DIGITAL NUMBERS

FIELD AND BACKGROUND OF THE INVENTION

Persons studying or working in the field of computer science are familiar with a number of differing numbering systems used in computer operations and with the difficulty sometimes encountered in easily and quickly registering a number in one system and then coverting the number into another system. Such difficulties may be compounded by the orders of magnitude designations used to indicate those number series which represent values that are quite large or quite small. As used herein, the phrase "number series" means a series of indicia such as digits which represent a particular numberical value. The difficulties of such registering and conversion have been addressed in prior publications including standard texts in the field and in prior patents such as Haase U.S. Pat. No. 3,843,048 and Hancock U.S. Pat. No. 3,916,161, to which the interested reader is referred.

BRIEF DESCRIPTION OF INVENTION

With the foregoing in mind, it is an object of this invention to provide a manual calculator which readily accmoplishes the registering of a number series in a selected numbering system (such as binary) and facilitates conversion of that number series into another numbering system (such as decimal). In realizing this object of the present invention, a plurality of slides are used to indicate selected states and are arranged in an array such that the positions of the slides in the array enable the conversion. In accordance with the invention, the slides move perpendicularly to indicia corresponding to at least one selected numbering system, and preferably several selected numbering systems.

A further object of this invention is to assist a person engaged in the manipulation of numbers using computational numbering systems to conveneiently register a number and then directly and easily convert the number into alternate numbering systems. In realizing this object of the present invention, a user of the calculator of this invention may position slides to represent a number and then, with the slides remaining in position, refer to sets of indicia associated with the slides to determine the way in which the number would be represented in alternate numbering systems such as binary, decimal, octal, hexidecimal, binary coded decimal and possibly others.

Yet a further object of the invention is to teach and demonstrate graphically and numerically the interrelationships of and between numbering systems.

BRIEF DESCRIPTION OF DRAWING

Some of the objects of the invention having been stated, other objects will appear as the description proceeds when taken in connection with the accompanying drawings, in which.

DETAILED DESCRIPTION OF INVENTION

Figure 1:
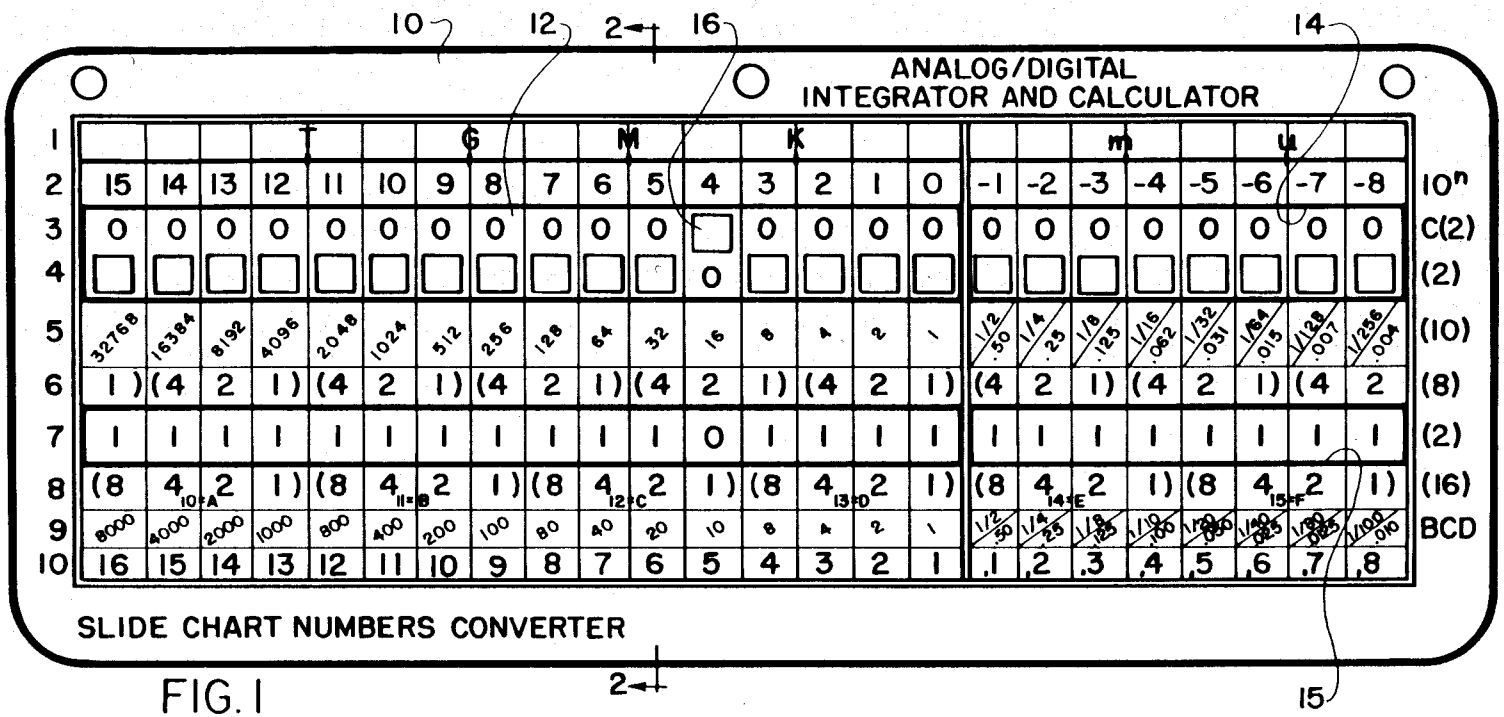
FIG. 1 is a plan view of the calculator of the present invention.
Figure 2:
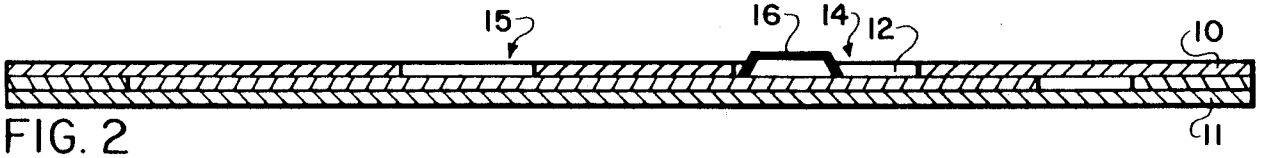
FIG. 2 is an enlarged elevation view, in section, taken generally along the line 2—2 in FIG. 1.

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the drawing, the manual calculator of this invention, in a preferred form, has a generally rectangular front cover means indicated at 10 (FIG. 1) and a generally rectangular back cover means (not visible in any view). The cover means may take any form, and front and back cover means are indeed not necessary, as there are ways known to the present inventor of providing the necessary structure without the necessity of front and back cover means, such as by arranging elongate slides in slots formed in a single sheet or plane of material. The significant structure and function is that the cover means supports a plurality of elongate slide members 11 arranged in parallel array and each being movable longitudinally between first and second positions.

In the preferred form of this invention, the first and second positions are representative or indicative of one or the other of two states, as in the binary system zero and one which form the basis of certain computer operations. In the form illustrated, each slide member 11 is mounted between the cover means or "sandwiched" so as to be confined to movement along its longitudinal axis. Each is visible through at least one window formed in the front cover means 10. In the form illustrated, two such windows 14, 15 are provided. Each slide member carries a stop member 16 positioned to be received within a window 14 and serving to limit the extent of movement of the slide members relative thereto to the first and second positions described above.

For each slide member, the stop member 16 additionally serves as a n indicia indicative of a state, such as a binary digit "1". The spaces encompassed by the windows 14, 15 are such that in one instance (the upper window 14) two indicia on each slide member are visible, while in the other (the lower window 15) only one indicia is visible. Thus in one window both states are displayed, while in the other only one is displayed. This opens the possibility (mentioned hereinafter) of displaying binary complement number series.

Arranged on the cover means and perpendicularly to the direction of movement of the slide members are a seires of indicia which enable conversion of number series in accordance with the state objects of this invention. Such indicia are arranged, in the illustrated embodiment, in rows or lines identified by digits appearing at the left hand end of the calculator. Row 1 has the letter designations of orders of magnitude, such as "K" for Kilo- and "m" for milli-. The row is divided by a decimal position indicating doubled line, referred to hereinafter. Row 2 is an exponential scale, indicating the exponent applied to the base 10 for the value displayed in the associated column. As used herein, the word "column" refers to the array of rows aligned with the direction of movement of the slide members. Row 3 is in fact the upper portion of the window 14, and is a binary complement scale. Row 4 is the lower portion of the window 14 and a binary scale. Row 5 is a decimal scale. Row 6 is an octal scale. Row 7 is the lower window 15 and a binary scale like row 4. Row 8 is a hexadecimal scale. Row 9 is a binary coded decimal scale. Row 10 is a bit designation scale as used by certain computer manufacturers.

As will be noted, most of the rows also have identifying designators at the right hand end of the array shown in FIG. 1. As will be appreciated, the array of rows shown and described is that presently preferred. However, persons skilled in the arts requiring number conversion will be aware that rows may be left off or added or rearranged or reorganized in order to arrive at a result which is useful in the conversions Which they must make. It is contemplated that all such variations of row arrangement shall be within the scope of the present invention where a plurality of slide members and rows perpendicular to the direction of movement of the slide members are used as here described.

In using the calculator of this invention, slide members are manipulated using the stop members 16 to indicate a particular number series. THere are certain rules to be followed in such manipulation. Generally, the sequence of conversion may begin from a number in any one system, convert the number into the binary system, and then go further into conversion into any other system. The calculator is "cleared" by moving all of the slides to such a position that the indicia shown in row 4 are all zeros. By inspection of the rows, a slide is then selected for movement to the alternate position. For example, in converting the decimal number 94.562, that number in the decimal row, row 5, which is less than and most nearly eqaual to 94 is the number 64 appearing in the seventh column to the left of the doubled line indicative of decimal position. The associated slide is moved to the position to indicate a "1" in row 4. The value "64" is then subtracted from the value "94" being converted, leaving a remainder of 30. The number in the decimal row which is less than and most nearly equal to the remainder value is associated with the fifth slide to the left of the doubled decimal line, and that slide is accordingly moved. The process is continued, moving to the right and toward the doubled decimal indicating line, as the next three slides are also moved. The binary equivalent of the decimal digits to the left of the decimal place is then directly displayed as 1011110. The process may the continue to the right of the doubled decimal indicating line to display the binary equivalent of the decimal value 0.5625 to be 0.1001. Thus 94.562 in decimal may be converted to 1011110.1001 in binary.

As will be noted, the numbers appearing in the octal row 6 and hexadecimal row 8 are grouped by inclusion within parenthesis into groups of (4 2 1) and (8 4 2 1). For further conversion of the number used as an example above, and by direct inspection of the calculator with slides in the position described, it would be noted from rows 6, 7 and 8 that where ever a binary "1" appears, the octal number within the corresponding parenthesis should be added. Thus, from the third set leftward of the decimal line in row 8, derive a 1; the seconds, 2 and 1 added to derive 3; the first, 4 and 2 added to derive 6. Reading rightward of the decimal line, the first and second sets each derive 4. Thus the octal system equivalent number series is 136.44. Hexadecimal conversion proceeds similarly, in groups of (8 4 2 1), and identifies the equivalent number to be 5E.9, recognizing the hexadecimal use of alphabetic designators for certain numeric values from 10 to 15, as shown in row 8 where 10=A; 11=b; 12=c; 13=d; 14=e; and 15=F.

For a binary coded decimal conversion, add all numbers in row 9 above which a "1" appears in row 7. Thus, in the working example, add 40 and 10 and 8 and 4 and 2 to derive that portion of the number series leftward of the decimal and 0.5 and 0.1 to derive that portion of the number series rightward of the decimal. The converted number series is thus 64.6.

Row 10 enables a person interested in determining data bit designations internally within a computer to determine directly which bits would be high and which low.

Row 1 enables conversion among, or determination of, order to magnitude designations such as T(era-), G(iga-), M(ega-), K(ilo-), m(illi-) and micro-. An example of use may be that a stop means 16 may be used to designate the most significant figure of a number series and, when displaced, indicate which order of magnitude designator is applicable. Thus, with a decimal number series 4100, the fourth slide leftward of the decimal line may be moved, thereby indicating that the order of magnitude of 4100 is 4.1 Kilo-, or 0.0041 Mega or 4100000 milli-. Row 2 enables conversion therefrom directly into the exponential system for powers of 10.

The examples given are based upon conversion from system to a number indicated on other rows or numbering systems. Conversely, such conversions may start from the indication of a number on any row and proceed toward a representation of that number in any other numbering system among those to be found in the rows used.

As will be appreciated, where two cover surfaces are available for the display of the rows described hereinabove, such information may be distributed should that be preferred. Similarly, the surface of one cover, where two are provided, may remain unmarked or may bear other useful information such as instruction for use of the calculator.

In the drawings and specifications there has been set forth a preferred embodiment of the invention and, although specific terms are used, the descritpion thus given uses terminology in a generic and descriptive sense only and not for purposes of limitation.

What is claimed is:

1. A manual calculator useful in registering numbers and converting whole and fractional numbers from one numbering system to another numbering system and comprising means for defining a cover having a predetermined configuration and a plurality of slide members arranged in an array within said cover means, each said slide member being movable relative to said cover means between first and second positions, said slide member each bearing indicia indicative of a selected one of two states, said cover means defining an elongate window in which the indicia borne by the slide members are visible in an array indicative of a selected number series in a first numbering system, and said cover means bearing a plurality of sets of indicia with each set having a predetermined correlation to number series expressed in a differing preselected numbering system, said sets of indicia being arranged relative to said window and said slide members with each set in a corresponding row parallel to said window and said plurality of sets in columns perpendicular to the direction of movement of said slide members and with numerical values in each said system aligned with a corresponding one of said slide members whereby the positioned of said slide members may be manipulated to indicate a number series in a first numbering system and corresponding number series in different numbering systems.

2. A calculator according to claim 1 wherein said sets of indicia include a set indicative of numbers in a binary numbering system.

3. A calculator according to claim 1 wherein said sets of indicia include a set indicative of numbers in a decimal numbering system.

4. A calculator according to claim 1 wherein said sets of indicia include a set indicative of numbers in an octal numbering system.

5. A calculator according to claim 1 wherein said sets of indicia include a set indicative of numbers in a hexadecimal numbering system.

6. A calculator according to claim 1 wherein said sets of indicia include a set indicative of numbers in a binary coded decimal system.

7. A calculator according to claim 1 wherein said sets of indicia include a set indicative of numbers in an exponential system.

8. A calculator according to claim 1 wherein said sets of indicia include a set indicative of bit designations in computer applications.

9. A calculator according to claim 1 wherein said sets of indicia include a set indicative of order of magnitude designations.

10. A manual calculator useful in registering numbers and in converting whole and fractional numbers from one numbering system to another numbering system and comprising back cover means: front cover means having a configuration matching that of said back cover means and being secured thereto in a congruent position; and a plurality of elongate slide members arranged in a parallel array between said cover means and each being movable longitudinally relative to said from cover means between first and second positions; said slide members each bearing indicia indicative of a first state associated with said first position and a second state associated with said second position; said front cover means defining an elongate window in which the indicia borne by the slide members are visible in a parallel array indicative of a selected number series in a first numbering system; and said front cover means bearing a plurality of sets of indicia with each set having a predetermined correlation to number series expressed in a preselected one of numbering systems including decimal, octal, hexadecimal, and binary coded decimal; said sets of indicia being arranged relative to said window and said slide member with each set in a corresponding row parallel to said window and said plurality of stes in columns perpendicular to the direction of movement of said slide members and with numerical values in each said system aligned with a corresponding one of said slide members whereby the positions of said slide members may be manipulated to indicate corresponding number series in different numbering systems.

11. A calculator according to claim 10 wherein said front cover means defines a plurality of windows and further wherein the indicia on said slide members are such that a binary number displayed in one of said windows is the complement of a binary number displayed in another of said windows.

12. A calculator according to claim 10 further comprising stop means on each of said slide members and effective for limiting movement thereof relative to said window to said first and second positions.

* * * * *